US011223922B2

(12) United States Patent
Tatum et al.

(10) Patent No.: US 11,223,922 B2
(45) Date of Patent: Jan. 11, 2022

(54) DIRECTIONAL SOUND SYSTEM FOR A VEHICLE

(71) Applicant: Gulfstream Aerospace Corporation, Savannah, GA (US)

(72) Inventors: Josh Tatum, Savannah, GA (US); Matthew Wallace, Savannah, GA (US); John Bullock, Savannah, GA (US); John Marchetti, Savannah, GA (US)

(73) Assignee: Gulfstream Aerospace Corporation

( * ) Notice: Subject to any disclaimer, the term of this patent is extended or adjusted under 35 U.S.C. 154(b) by 0 days.

(21) Appl. No.: 16/948,749

(22) Filed: Sep. 30, 2020

(65) Prior Publication Data

US 2021/0120359 A1 Apr. 22, 2021

Related U.S. Application Data

(60) Provisional application No. 62/916,485, filed on Oct. 17, 2019.

(51) Int. Cl.

| | |
|---|---|
| ***H04S 7/00*** | (2006.01) |
| ***H04R 1/40*** | (2006.01) |
| ***H04R 3/12*** | (2006.01) |
| ***H04R 5/02*** | (2006.01) |

(52) U.S. Cl.

CPC ..... *H04S 7/303* (2013.01); *H04R 1/403* (2013.01); *H04R 3/12* (2013.01); *H04R 5/02* (2013.01); *H04R 2201/40* (2013.01); *H04R 2430/20* (2013.01); *H04R 2499/13* (2013.01)

(58) Field of Classification Search

CPC combination set(s) only.
See application file for complete search history.

(56) References Cited

U.S. PATENT DOCUMENTS

| | | | | |
|---|---|---|---|---|
| 5,450,624 | A * | 9/1995 | Porambo | H04B 17/20 455/226.4 |
| 2004/0190726 | A1* | 9/2004 | Imadate | H04R 5/04 381/11 |
| 2013/0178964 | A1* | 7/2013 | Bergmann | H04S 7/308 700/94 |
| 2016/0203811 | A1* | 7/2016 | Brockmole | G10H 1/18 381/94.5 |
| 2017/0006400 | A1* | 1/2017 | Robertson | H04S 3/02 |
| 2017/0064445 | A1* | 3/2017 | Pierfelice | H04R 3/04 |
| 2018/0232201 | A1* | 8/2018 | Holtmann | G01S 13/726 |
| 2018/0272977 | A1* | 9/2018 | Szawarski | B60N 2/04 |

* cited by examiner

*Primary Examiner* — Duc Nguyen
*Assistant Examiner* — Assad Mohammed
(74) *Attorney, Agent, or Firm* — LKGlobal | Lorenz & Kopf, LLP

(57) ABSTRACT

Vehicles and sound systems for vehicles are provided. In one example, the sound system includes a plurality of sound producing devices. An amplifier is in communication with the sound producing devices. The amplifier is configured to receive input channels of audio content, to map the input channels with output channels to the sound producing devices in one of stereo mode and surround sound mode, and to remap the input channels with the output channels to the sound producing devices in the other of the stereo mode and the surround sound mode.

18 Claims, 3 Drawing Sheets

DIRECTIONAL SOUND SYSTEM FOR A VEHICLE

CROSS-REFERENCE TO RELATED APPLICATIONS

This application is related to and claims all available benefit of U.S. Provisional Patent Application 62/916,485 filed Oct. 17, 2019, the entire contents of which are herein incorporated by reference.

TECHNICAL FIELD

The technical field relates generally to sound systems for vehicles, and more particularly, relates to sound systems that are configured to map and remap audio input channels with output channels for stereo and surround sound modes for vehicles, for example aircraft or the like.

BACKGROUND

Providing sound systems for communicating, providing information, entertainment, or the like for passengers and/or other occupants of vehicles has traditionally been a priority for vehicle manufacturers. For example, sound systems are often provided in many aircraft for such purposes.

Existing sound systems for aircraft and/or other vehicles are directionally static. Speakers are positioned at predetermined locations and the sound system's computer or controller is connected to the speakers and controls each speaker to produce sound in a manner that surrounds one or more listeners with sound based on each speaker's location and further based on an assumed listener orientation. For example, the sound system may be designed to provide stereo sound ambient music for listeners who are facing forward or rearward in the cabin of an aircraft. If, however, a listener(s) changes their orientation within the cabin, such as when they reorient or change their seat to watch a movie on a screen located along a cabin wall, now the listener(s) is oriented laterally within the cabin facing the cabin wall. As such, if the listener(s) wants the sound system to provide surround sound, the sound system cannot properly do so because the listener(s) is now reoriented, for example, ninety degrees out of phase, to the directionally static speakers of the sound system.

Accordingly, it is desirable to provide sound systems for a vehicle that addresses one or more of the foregoing issues. Furthermore, other desirable features and characteristics of the various embodiments described herein will become apparent from the subsequent detailed description and the appended claims, taken in conjunction with the accompanying drawings and this background.

SUMMARY

Various non-limiting embodiments of a vehicle, and various non-limiting embodiments of a sound system for a vehicle, are provided herein.

In a first non-limiting embodiment, the sound system includes, but is not limited to, a plurality of sound producing devices. The sound system further includes, but is not limited to, an amplifier that is in communication with the sound producing devices. The amplifier is configured to receive input channels of audio content, to map the input channels with output channels to the sound producing devices in one of stereo mode and surround sound mode, and to remap the input channels with the output channels to the sound producing devices in the other of the stereo mode and the surround sound mode.

In a second non-limiting embodiment, the vehicle includes, but is not limited to, a vehicle structure having a first side, a second side, and an interior area that is disposed between the first and second sides for accommodating a vehicle occupant. The vehicle further includes, but is not limited to, a sound system that is at least partially supported by the vehicle structure. The sound system includes, but is not limited to, a plurality of sound producing devices that are configured to provide sound to the interior area. The sound system further includes, but is not limited to, an amplifier that is in communication with the sound producing devices. The amplifier is configured to receive input channels of audio content, to map the input channels with output channels to the sound producing devices in one of stereo mode and surround sound mode, and to remap the input channels with the output channels to the sound producing devices in the other of the stereo mode and the surround sound mode.

BRIEF DESCRIPTION OF THE DRAWINGS

The various embodiments will hereinafter be described in conjunction with the following drawing figures, wherein like numerals denote like elements, and wherein.

DETAILED DESCRIPTION

The following Detailed Description is merely exemplary in nature and is not intended to limit the various embodiments or the application and uses thereof. Furthermore, there is no intention to be bound by any theory presented in the preceding background or the following detailed description.

The exemplary embodiments taught herein provide a sound system for vehicles, for example aircraft or the like. The sound system is configured to map and remap audio input channels with output channels for stereo and surround sound modes, for example, based on a position and/or orientation of the listener(s) and/or a user input provided to the sound system by the listener(s).

Figure 1:
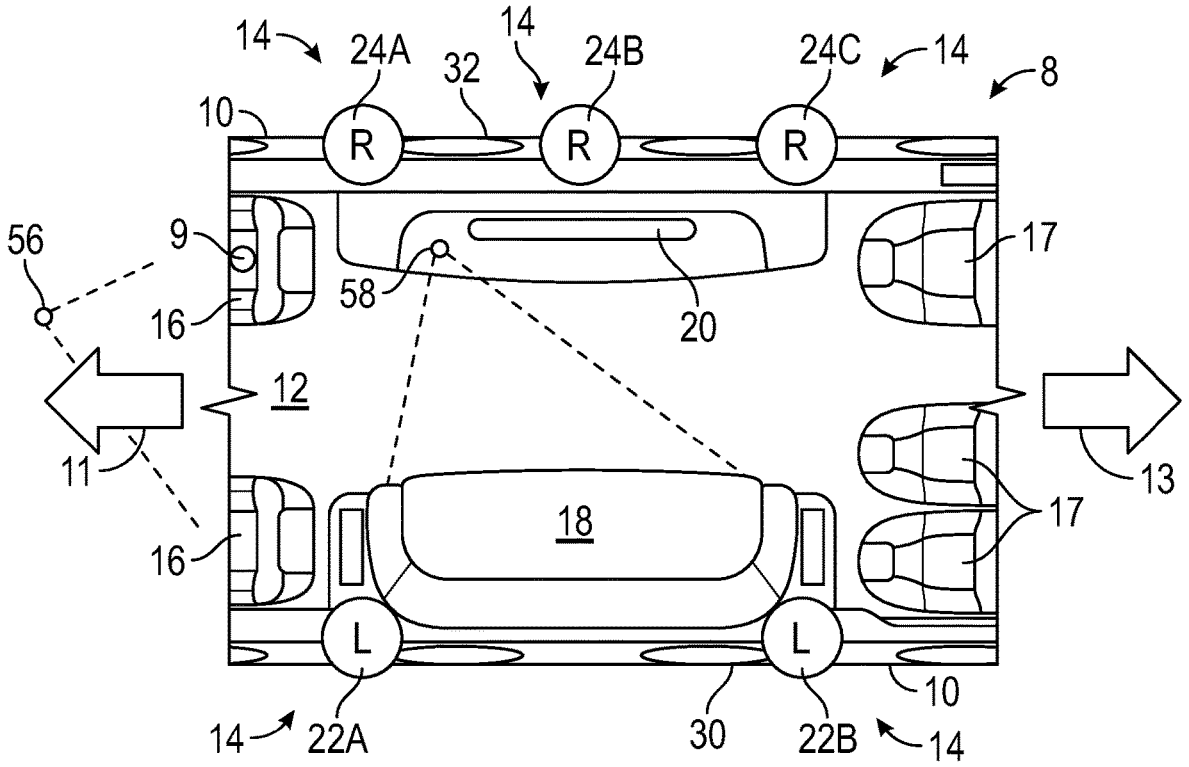
FIG. 1 illustrates a top view of an aircraft interior area with seating and a sound system including sidewall speakers operating in a stereo mode in accordance with an exemplary embodiment.
Figure 5:
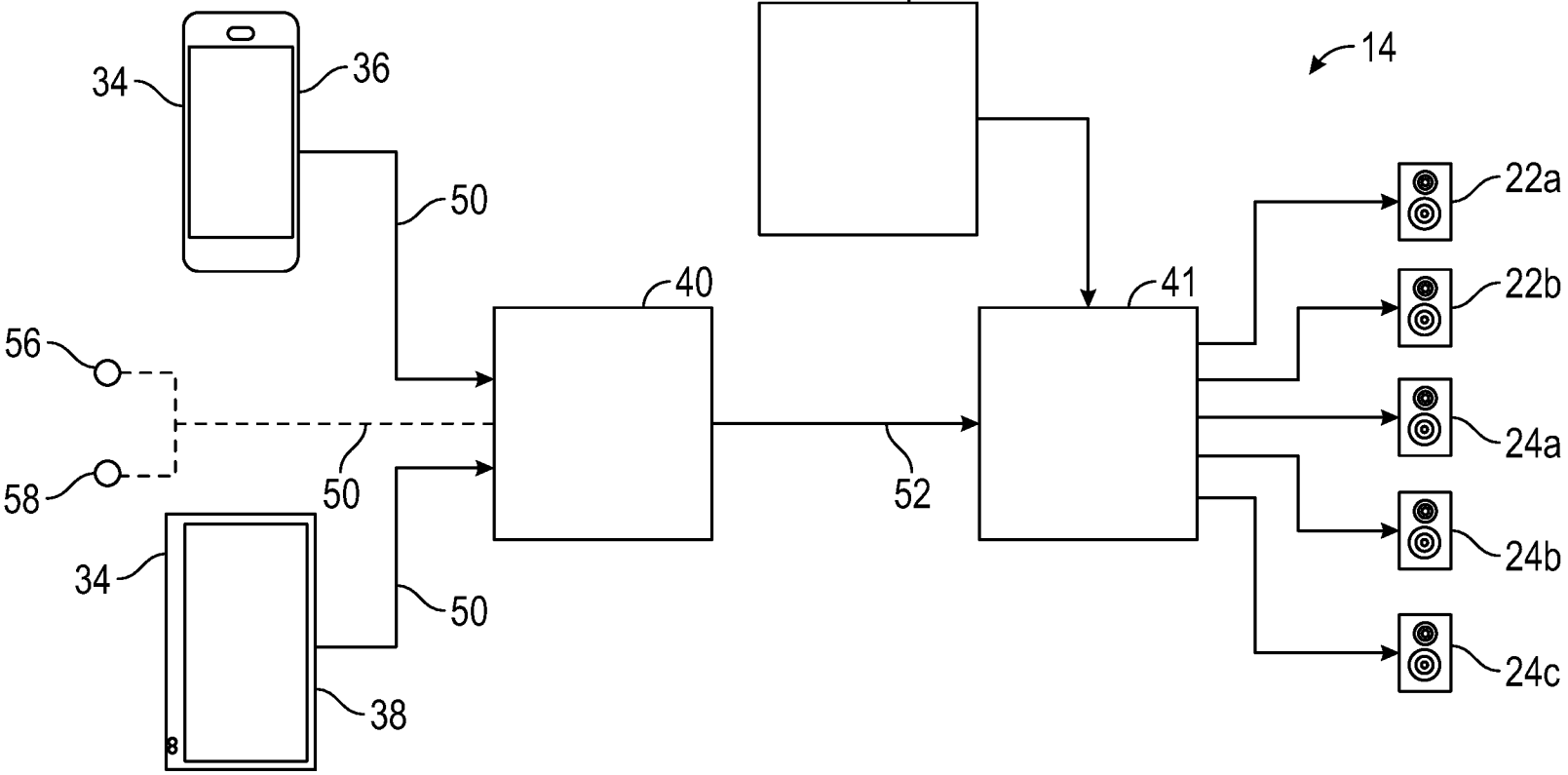
FIG. 5 illustrates a block diagram of a sound system for a vehicle in accordance with an exemplary embodiment.

FIG. 1 illustrates a top view of a portion of an aircraft 8 including an aircraft structure 10 at least partially surrounding an interior area 12 (e.g., cabin area or the like) and a sound system 14 that is disposed in the interior area 12. FIG. 5 illustrates a block diagram of the sound system 14 in accordance with an exemplary embodiment. Although the illustrated embodiment is shown with the sound system 14 disposed in the interior area 12 of the aircraft 8, it is to be understood that the sound system 14 may be disposed in an interior area that is at least partially surrounded by a vehicle structure of a vehicle other than an aircraft. In an exemplary embodiment, the sound system 14 is configured to provide audible or sound outputs to a vehicle occupant(s) 9 (e.g., an aircraft occupant(s), a user(s)/listener(s) or the like) within the vehicle.

As illustrated, the aircraft structure 10 extends longitudinally in forward and rearward directions 11 and 13 and includes a left sidewall 30 and a right sidewall 32, for example when facing in the forward direction 11 towards the aircraft cockpit (not shown). Disposed in the interior area 12, the aircraft 8 includes seating including seats 16 and 17 that are facing in the forward direction 11 and the rearward direction 13, respectively, and a couch 18 that is disposed between the seats 16 and 17. As illustrated, the couch 18 is disposed adjacent to the left sidewall 30 facing laterally from the forward and rearward directions 11 and 13 towards a monitor 20 that is disposed adjacent to the right sidewall 32 of the aircraft 8.

In an exemplary embodiment, the sound system 14 includes sound producing devices 22A, 22B, 24A, 24B, and 24C (e.g., speakers and/or transducers) supported by the aircraft structure 10 and configured to produce audible outputs (e.g., sound). As illustrated, the sound producing devices 22A and 22B are disposed on or adjacent to the left sidewall 30 and the sound producing devices 24A, 24B, and 24C are disposed on or adjacent to the right sidewall 32.

Figure 2:
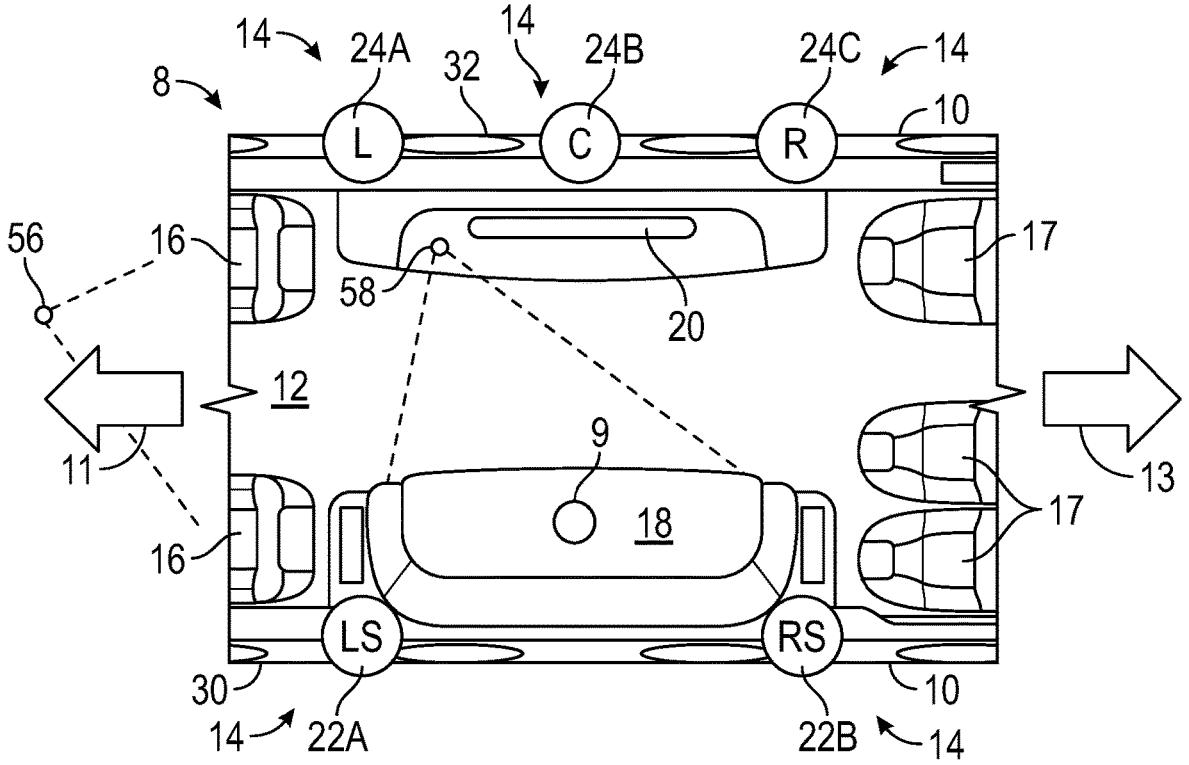
FIG. 2 illustrates a top view of an aircraft interior area with seating and a sound system including sidewall speakers operating in a surround sound mode in accordance with an exemplary embodiment.

Referring to FIGS. 1-2 and 5, in an exemplary embodiment, the sound system 14 is configured to switch between stereo mode (shown in FIG. 1) and surround sound mode (e.g., shown in FIG. 2). For example, if the vehicle occupant 9 (e.g., a user/listener) is seated in one of the seats 16 facing in the forward direction 11, the sound system 14 may be in a stereo mode in which the sound producing devices 22A and 22B provide left channel outputs and the sound producing devices 24A and 24C and optionally sound producing device 24B provide right channel outputs. Alternatively, if the vehicle occupant 9 for example moves to or is seated in the couch 18 facing laterally towards the monitor 20, the sound system 14 may be in the surround sound mode in which the sound producing devices 22A and 24A provide left channel outputs, the sound producing devices 22B and 24C provide right channel outputs, and the sound producing device 24B provides center channel outputs. More specifically, in an exemplary embodiment, the sound producing device 22A provides left surround channel outputs (e.g., left rear channel outputs) and the sound producing device 24A provides left front channel outputs, and the sound producing device 22B provides right surround channel outputs (e.g., right rear channel outputs) and the sound producing device 24C provide right front channel outputs. It is to be understood that if, for example, the couch 18 and the monitor 20 are repositioned such that the monitor 20 is disposed adjacent to the left sidewall 30 and the couch 18 is disposed adjacent to the right sidewall 32 facing towards the monitor 20, that the sound producing devices 22A-B would be disposed on or adjacent to the right sidewall 32 while the sound producing devices 24A-C would be disposed on or adjacent to the left sidewall 30 and that surround sound mode would be mapped such that the forward sound producing devices 22A and 24A with provide the right channel outputs, the rearward sound producing devices 22B and 24C would provide the left channel outputs, and the middle sound producing device 24B would provide the center channel outputs. Likewise, if the vehicle occupant 9 for example moves from the couch 18 back to the seat 16, the sound system 14 is configured to switch from the surround sound mode to the stereo mode.

In an exemplary embodiment, the sound system 14 switches between stereo mode and surround sound mode by the vehicle occupant 9 selecting the mode on a user interface device 34. The user interface device 34 may be a mobile user interface device 36, for example a remote, tablet, smart phone, or the like that wirelessly communicates with a controller 40, or a fixed user interface 38, for example, a control panel or the like that is incorporated into the seat 16, the couch 18, or the adjacent area and that is hard wired to the controller 40. In one example, the vehicle occupant 9 selects the stereo mode (as illustrated in FIG. 1) while seated in the seat 16 and the user interface device 34 generates a command signal 50 indicative of the stereo mode. Alternatively, the vehicle occupant 9 selects surround sound (as illustrated in FIG. 2), a movie, or the like while seated in the couch 18 in front of the monitor 20 and the user interface device 34 generates a command signal 50 indicative of a surround sound mode.

The command signal 50 is communicated to the controller 40, for example a cabin management system, computer, device containing one or more processors, or the like. In response, the controller 40 generates a mapping command signal 52 that is communicated to the amplifier(s) 41. In an exemplary embodiment, the amplifier(s) 41 includes a digital signal processor(s) (DSP) 54 that is configured for mapping and remapping input channels from the audio content device 42 with output channels to the sound producing devices 22A-B and 24A-C. In an exemplary embodiment, in response to the mapping command signal 52, the DSP(s) 54 of the amplifier(s) 41, using an algorithm/logic, maps or remaps the input channels with the output channels, for example as discussed above with respect to the stereo mode (FIG. 1), or alternatively, the surround sound mode (FIG. 2).

Figure 3:
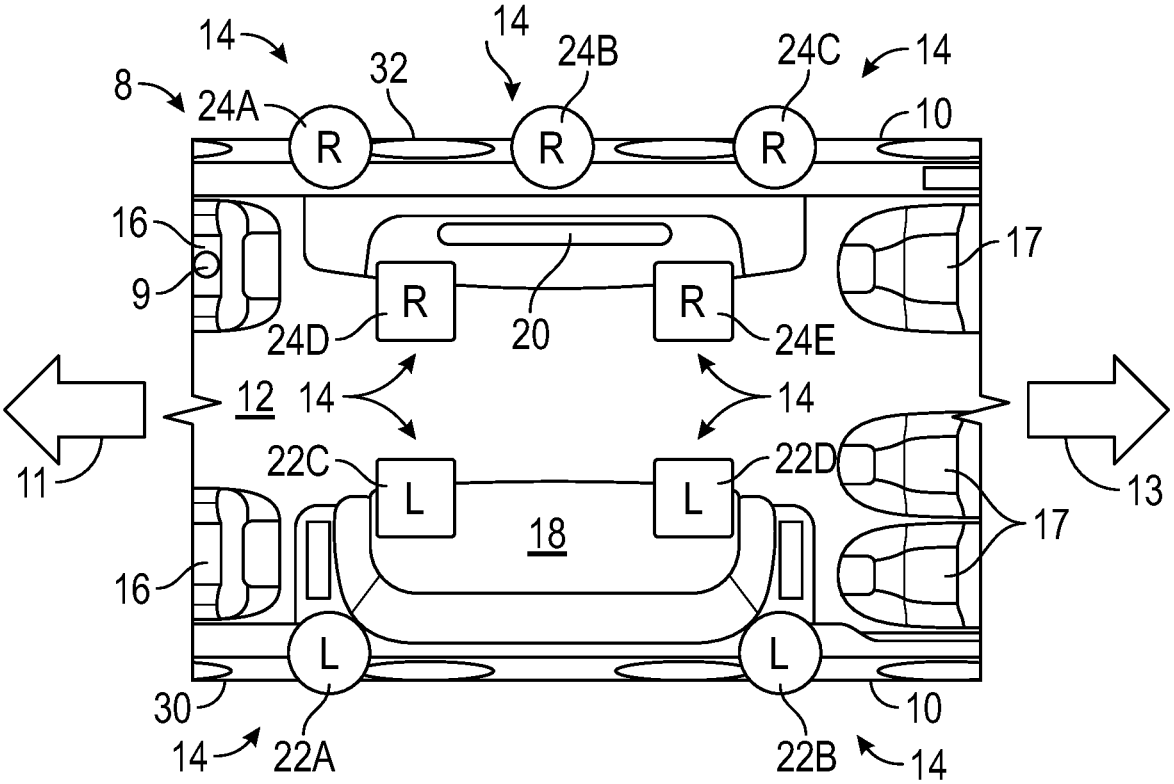
FIG. 3 illustrates a top view of an aircraft interior area with seating and a sound system including sidewall and overhead speakers operating in a stereo mode in accordance with an exemplary embodiment.
Figure 4:
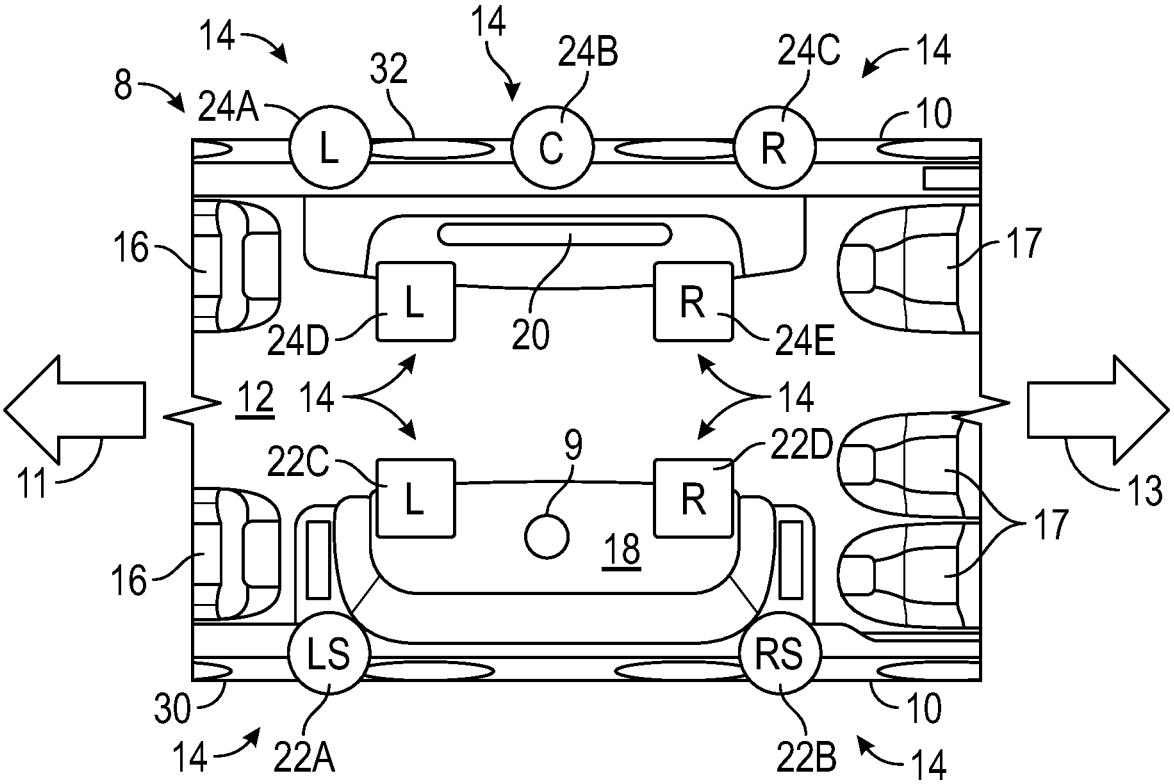
FIG. 4 illustrates a top view of an aircraft interior area with seating and a sound system including sidewall and overhead speakers operating in a surround sound mode in accordance with an exemplary embodiment.

Although the sound system 14 configuration illustrated in FIGS. 1-2 is shown as a 5 speakers and/or transducers (5 sound producing devices) sound system 14, for example for a 5.1 surround sound when in the surround sound mode (FIG. 2), it is to be understood that the sound system 14 may include less than 5 sound producing devices but at least 4 sound producing devices, or more than 5 sound producing devices, such as, for example, for a 6.1, 7.1, 8.1, 9.1, or the like surround sound when in the surround sound mode. For example and as illustrated in FIGS. 3-4, a 9 speaker and/or transducer sound system 14 is shown which further include overhead sound producing devices (e.g., speakers and/or transducers) 22C-D biased on the left side of the interior area 12 and 24D-E biased on the right side of the interior area 12. The 9 speaker and/or transducer sound system 14 operates as discussed above with respect to the 5 speaker and/or transducer sound system 14 as illustrated in FIGS. 1-2 and 5, but with the exception that in the stereo mode (FIG. 3), the sound producing devices 22A-D provide left channel outputs and the sound producing devices 24A-E (optionally the sound producing device 24B) provide right channel outputs. While in the surround sound mode (FIG. 4), the sound producing devices 22A, 22C, 24A, and 24D provide left channel outputs, the sound producing devices 22B, 22D, 24C, and 24E provide right channel outputs, and the sound producing device 24B provides center channel outputs.

Referring to FIGS. 1-2 and 5, in an exemplary embodiment, instead of using a user interface device 34 for providing the command signal 50 indicative of either a stereo mode or a surround sound mode, the interior area 12 of the aircraft 8 may include one or more sensors/detectors 56 and 58 that are able to determine the orientation and/or position of the vehicle occupant 9 (e.g., a user/listener or a group of users/listeners) and, from this information, is able to determine which way to orient the production of sound (either fore and aft within the interior area or laterally within the interior area 12). The sensors/detectors 56 and 58 may communicate this information to the controller 40 via command signal 50 as discussed above or alternatively the sound system 14 can include a series of relays that will transfer a first group of sound signals to a first group of speakers and a second group of sound signals to a second group of speakers when the vehicle occupant(s) is oriented in a first direction. When the sound system 14 detects that the orientation of the vehicle occupant(s) 9 has changed, the sound system 14 will trip the relays and begin sending the first group of sound signals to the second group of speakers and the second group of sound signals to the first group of speakers, effectively changing the orientation of the surround sound emitted by the speakers.

In an additional embodiment, the sound system 14 is able to determine which display or entertainment system 20 within the interior area 12 is being utilized by the vehicle occupant(s) 9, for example, via sensors or the like. Based on this information, the sound system 14 remaps the input channels and the output channels as discussed above.

While at least one exemplary embodiment has been presented in the foregoing detailed description of the disclosure, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing an exemplary embodiment of the disclosure. It being understood that various changes may be made in the function and arrangement of elements described in an exemplary embodiment without departing from the scope of the disclosure as set forth in the appended claims.

What is claimed is:

1. A sound system for a vehicle, the sound system comprising:
- a plurality of sound producing devices; and
- an amplifier in communication with the sound producing devices, wherein the amplifier is configured to:
  - receive input channels of audio content;
  - map the input channels with output channels to the sound producing devices in one of stereo mode and surround sound mode; and
- remap the input channels with the output channels to the sound producing devices in the other of the stereo mode and the surround sound mode, wherein the plurality of sound producing devices comprises:
  - a first sound producing device, a second sound producing device, a third sound producing device, and a fourth sound producing device that are in communication with the amplifier, wherein when the output channels to the sound producing devices are in the stereo mode the first and second sound producing device provide left channel outputs and the third and fourth sound producing devices provide right channel outputs, and wherein when the output channels to the sound producing devices are in the surround sound mode the first and third sound producing devices provide the left channel outputs and the second and fourth sound producing devices provide right channel outputs.

2. The sound system of claim 1, wherein the amplifier comprises a digital signal processor (DSP) that uses an algorithm to map and remap the input channels with the output channels.

3. The sound system of claim 1, further comprising an audio content device that is operable to generate audio content and that is in communication with the amplifier to provide the input channels of the audio content to the amplifier.

4. The sound system of claim 1, wherein the plurality of sound producing devices further comprises a fifth sound producing device that is in communication with the amplifier, and wherein when the output channels to the sound producing devices are in the stereo mode the fifth sound producing device provide one of the left channel outputs and the right channel outputs, and wherein when the output channels to the sound producing devices are in the surround sound mode the fifth sound producing device provides center channel outputs.

5. The sound system of claim 1, wherein when the output channels to the sound producing devices are in the surround sound mode the first and third sound producing devices provide the left channel outputs as left front channel outputs and left surround channel outputs, respectively, and the second and fourth sound producing devices provide right channel outputs as right front channel outputs and right surround channel outputs, respectively.

6. The sound system of claim 1, further comprising a controller in communication with the amplifier, wherein the controller is configured to receive a command signal indicative of one of the stereo mode and the surround sound mode and to generate a mapping command signal that is communicated to the amplifier for one of mapping and remapping the input channels with the output channels in response to the command signal.

7. The sound system of claim 6, further comprising a user interface device that is in communication with the controller, wherein the user interface device is configured to receive a user input selecting one of the stereo mode and the surround sound mode and to generate the command signal in response to the user input.

8. The sound system of claim 6, further comprising at least one sensor that is in communication with the controller, wherein the at least one sensor is configured to determine at least one of a position and orientation of a vehicle occupant and to generate the command signal in response to the at least one of the position and orientation of the vehicle occupant.

9. The sound system of claim 1, wherein the sound system including the plurality of sound producing devices are configured to produce one of 5.1, 6.1, 7.1, 8.1, and 9.1 surround sound when in the surround sound mode.

10. The sound system of claim 1, wherein the sound producing devices are selected from speakers, transducers, and a combination thereof.

11. A vehicle comprising:
- a vehicle structure having a first side, a second side, and an interior area disposed between the first and second sides for accommodating a vehicle occupant;
- a sound system at least partially supported by the vehicle structure, the sound system comprising:
  - a plurality of sound producing devices configured to provide sound to the interior area; and
  - an amplifier in communication with the sound producing devices, wherein the amplifier is configured to:
    - receive input channels of audio content;

map the input channels with output channels to the sound producing devices in one of stereo mode and surround sound mode; and remap the input channels with the output channels to the sound producing devices in the other of the stereo mode and the surround sound mode, wherein the plurality of sound producing devices comprises:

a first sound producing device and a second sound producing device that are disposed proximate to the first side of the vehicle structure and that are in communication with the amplifier, and a third sound producing device and a fourth sound producing device that are disposed proximate to the second side of the vehicle structure and that are in communication with the amplifier, wherein when the output channels to the sound producing devices are in the stereo mode the first and second sound producing device provide left channel outputs and the third and fourth sound producing devices provide right channel outputs, and wherein when the output channels to the sound producing devices are in the surround sound mode the first and third sound producing devices provide the left channel outputs and the second and fourth sound producing devices provide right channel outputs.

12. The vehicle of claim 11, wherein the sound system further comprises an audio content device that is operable to generate audio content and that is in communication with the amplifier to provide the input channels of the audio content to the amplifier.

13. The vehicle of claim 11, wherein the amplifier comprises a digital signal processor (DSP) that uses an algorithm to map and remap the input channels with the output channels.

14. The vehicle of claim 1, wherein the plurality of sound producing devices further comprises a fifth sound producing device that is disposed between one of the first and second sound producing devices and third and fourth sound producing devices and that is in communication with the amplifier, and wherein when the output channels to the sound producing devices are in the stereo mode the fifth sound producing device provide one of the left channel outputs and the right channel outputs, and wherein when the output channels to the sound producing devices are in the surround sound mode the fifth sound producing device provides center channel outputs.

15. The vehicle of claim 1, wherein when the output channels to the sound producing devices are in the surround sound mode the first and third sound producing devices provide the left channel outputs as left front channel outputs and left surround channel outputs, respectively, and the second and fourth sound producing devices provide right channel outputs as right front channel outputs and right surround channel outputs, respectively.

16. The vehicle of claim 11, wherein the sound system further comprises a controller in communication with the amplifier, wherein the controller is configured to receive a command signal indicative of one of the stereo mode and the surround sound mode and to generate a mapping command signal that is communicated to the amplifier for one of mapping and remapping the input channels with the output channels in response to the command signal.

17. The vehicle of claim 16, wherein the sound system further comprises a user interface device that is in communication with the controller, wherein the user interface device is configured to receive a user input selecting one of the stereo mode and the surround sound mode and to generate the command signal in response to the user input.

18. The vehicle of claim 16, wherein the sound system further comprises at least one sensor that is in communication with the controller, wherein the at least one sensor is configured to determine at least one of a position and orientation of a vehicle occupant and to generate the command signal in response to the at least one of the position and orientation of the vehicle occupant.

* * * * *